United States Patent [19]

Meng

[11] Patent Number: 4,708,584

[45] Date of Patent: Nov. 24, 1987

[54] SHROUDED INDUCER PUMP

[75] Inventor: Sen Y. Meng, Reseda, Calif.

[73] Assignee: Rockwell International Corporation, El Segundo, Calif.

[21] Appl. No.: 917,337

[22] Filed: Oct. 9, 1986

[51] Int. Cl.[4] ..... F04D 29/66

[52] U.S. Cl. ..... 415/53 R; 415/169 R; 415/DIG. 1; 416/192

[58] Field of Search ..... 415/11, 53 R, 115, 116, 415/121 A, 169 R, 172 A, 219 A, DIG. 1; 416/181, 189, 191, 192

[56] References Cited

U.S. PATENT DOCUMENTS

| | | | |
|---|---|---|---|
| 3,901,620 | 8/1975 | Boyce | 415/53 R X |
| 3,993,414 | 11/1976 | Meauze et al. | 415/DIG. 1 X |
| 4,357,914 | 11/1982 | Hauser | 415/53 R X |
| 4,375,937 | 3/1983 | Cooper | 415/53 R |
| 4,642,023 | 2/1987 | Dunn | 415/53 R |

FOREIGN PATENT DOCUMENTS

| | | | |
|---|---|---|---|
| 56971 | 11/1939 | Denmark | 415/DIG. 1 |
| 57-65804 | 4/1982 | Japan | 415/DIG. 1 |
| 57-110800 | 7/1982 | Japan | 415/53 R |
| 619722 | 3/1949 | United Kingdom | 415/DIG. 1 |

*Primary Examiner*—Robert E. Garrett
*Assistant Examiner*—Joseph M. Pitko
*Attorney, Agent, or Firm*—H. Fredrick Hamann; Harry B. Field; Clark E. DeLarvin

[57] ABSTRACT

An improvement in a pump including a shrouded inducer, the improvement comprising providing means for collecting recirculation flow about said inducer and directing it through a fluid permeable wall member to remove any tangential velocity components from the recirculation flow. The recirculation flow, free of tangential velocity components, is then reintroduced into the fluid to be pumped.

12 Claims, 1 Drawing Figure

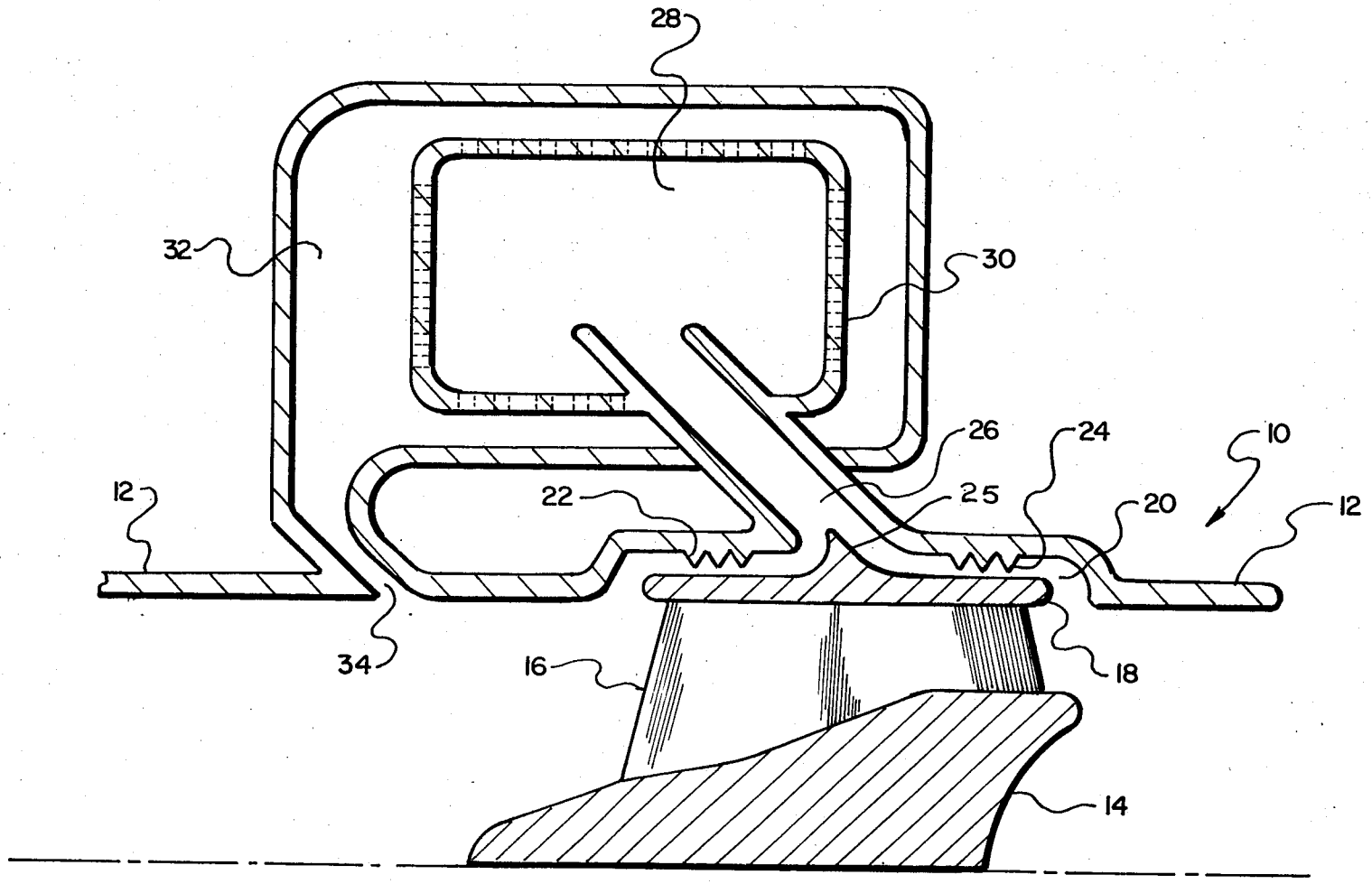
10
12
20
24
18
14
30
26
25
28
22
16
34
32
12

SHROUDED INDUCER PUMP

BACKGROUND OF THE INVENTION

1. Field of the Invention

The present invention relates to centrifugal pumps and more particularly to a shrouded inducer for use with a centrifugal pump. The present invention is more particularly directed to eliminating the cavitation damage which normally would result from a recirculation flow of fluid about the shroud of the inducer.

2. Description of the Prior Art

It has been found that the addition of the shroud to an otherwise shroudless inducer arrests the formation of vortices at or about the tips of the inducer blades and thus avoids the cavitation damage to the inducer associated with said vortices. The addition of a shroud, however, creates problems of its own in that a portion of the fluid downstream of the inducer tends to recirculate about the outer periphery of the shroud and re-enters the main flow just upstream of the inducer blades. As the recirculating fluid emerges from behind the forward or downstream edge of the shroud, it will often shed vortices which impinge directly upon the more radially outward portions of the inducer blades. These vortices create an erosive action upon the inflicted portions of the blades and ultimately result in the inducer suffering a similar loss in efficiency and structural integrity as a shroudless inducer. Thus, the use of a shroud to avoid the problems associated with blade tip vortices is compromised by the problems associated with vortices shed at the forward edge of the shroud.

Various attempts have been made to overcome the problems associated with recirculation flow about a shrouded inducer. For example, labyrinth seals have been placed about the outer periphery of the inducer shroud to minimize recirculation flow over the shroud. However, no matter how good the labyrinth seal, there is always some amount of flow which passes over the seal which will then cause the aforementioned vortices problem. Moreover, as time goes by, labyrinth seals tend to lose their sealing effectiveness, especially in pumps where vibration and thermodynamics subject the seal to any degree of rubbing. An extensive use of labyrinth seals could be employed to reduce the recirculation flow to a minimum such as is suggested in U.S. Pat. No. 2,984,189. Such an extensive use of seals, however, is impractical and costly. Various other methods have been proposed with regard to the construction of a shrouded inducer to overcome the problems associated with vortices emanating from the shroud. None of these, however, has been altogether effective or practical from a cost point of view.

OBJECTS OF THE INVENTION

It is an object of the present invention to provide a shrouded inducer which avoids the cavitation damage that would result from fluid recirculating about the shroud.

It is another object of the invention to provide a shrouded inducer which does not require an extensive use of the labyrinth seals.

Yet another object of the invention is to provide a shrouded inducer pump which will suffer no cognizable degree of cavitation damage either from tip vortices or form vortices shed by fluid being recirculated about the shrouded inducer.

Still another object of the invention is to provide a shrouded inducer pump in which fluid recirculating about the shroud may be reintroduced into the inlet with minimal disruption of the inlet flow pattern.

SUMMARY OF THE INVENTION

The foregoing and other objects are accomplished by the present invention. Broadly, the invention comprises an improvement in a pump having a shrouded inducer including at least one spiral blade circumferentially surrounded by a shroud. The inducer being rotatably mounted within a housing. Typically the housing will have a fluid inlet and a fluid outlet and there will be an annular space defined by an outer periphery of the shroud and adjacent surface of the housing which conveys a recirculation flow of fluid over the shroud during operation of the pump. The present invention provides an improvement for alleviating cavitation damage associated with such recirculation flow. The improvement comprises:

first seal means located adjacent an upstream end of said shroud;

second seal means located adjacent a downstream end of said shroud;

diffuser means, said diffuser means including a passageway in said housing providing fluid communication between said annular space, between said first and second seal means and a mixing zone having at least one fluid permeable wall portion; and a diverter means located on an outer surface of said shroud intermediate said seal means for directing fluid flow into said diffuser means.

In accordance with one preferred embodiment of the invention, the fluid permeable wall portion is enclosed within a collection zone in said housing and means are provided for reintroducing recirculation flow into fluid flowing into said pump.

Other objects, advantages and novel features of the present invention will become apparent from the following detailed description of the invention when considered in conjunction with the accompanying drawing.

BRIEF DESCRIPTION OF THE DRAWINGS

FIG. 1 is a schematic cross-sectional side view of a portion of a centrifugal pump having a shrouded inducer constructed according to a preferred embodiment of the present invention.

The same elements or parts throughout the figures of the drawing are designated by the same reference characters.

DETAILED DESCRIPTION OF THE DRAWINGS

Referring to FIG. 1, a preferred embodiment of the present invention there is depicted a schematic of the essential elements of a shrouded inducer pump 10 constructed in accordance with the present invention. The pump includes a housing 12 containing a rotatable rotor 14 provided with blades 16. A substantially cylindrical shroud member 18 is attached to the outer edge of blade 16 and surrounds blades 16 and rotor 14. As depicted, shroud member 18 extends into a recessed portion 20 of housing 12. A labyrinth seal means 22 is provided adjacent an upstream end of shroud 18 and a downstream labyrinth seal means 24 adjacent the downstream end of shroud 18. The purpose of seal means 22 and 24 is of course to minimize the flow of recirculation fluid which would normally flow around shroud 18 through the annular passageway in recessed portion 20 defined by an outer surface of shroud 18 and the adjacent inner surface of housing 12.

Intermediate seal means 22 and 24 there is provided a vaneless diffuser comprising a passageway in housing 12 which provides fluid communication between the space between seal means 22 and 24 and a mixing chamber 28. Mixing chamber 28 is defined by walls 30. At least a portion of walls 30 are formed from a fluid permeable material. In the preferred embodiment depicted, mixing chamber 28 and walls 30 are confined within a flow collection zone 32 within housing 12. Flow collection zone 32 provides fluid communication back to an area adjacent the inlet of housing 12 via a fluid injection port 34.

In operation torque is applied to rotor 14 from an external power source (not shown). As fluid is introduced through the inlet of housing 12 blades 16 impart a pressure rise to the incoming fluid and a swirl pattern favorable to the pumping operation of, for example, the impeller of a centrifugal pump, the latter of which further increases the pressure of the fluid and discharges it into an outlet of housing 12. A portion of the fluid passing blades 16, especially that portion just downstream of blades 16, tends to enter the annular space defined between the outer periphery of shroud 18 and the adjacent portion of recess 20 in housing 12. Since this fluid is at a higher pressure than the incoming fluid at the inlet and because the pumping action induced by motion of the outer periphery of shroud 18 relative to the adjacent portion of pump housing 12, the fluid in annular space 20 tends to flow back to the left in the general direction of the inlet. This flow is what is herein referred to as a recirculation flow over the shroud, which, in the absence of the present invention, would cause cavitation damage to inducer blade 16 as would occur with prior art shrouded inducers. It must also be understood that the recirculation flow also includes a substantial tangential or swirl velocity component due to the rotational action of the shroud.

Because the rotation of the shroud of both this and the prior art shroud imparts a substantial tangential velocity component to the recirculating flow, the recirculating flow would tend to shed strong vortices from the inlet end of the shroud. This tendency would be further aggravated by the fact that the recirculation flow when it arrives at the inlet end of the shroud is flowing in an axial direction which opposes the incoming main flow. Since the vortices produced adjacent the upstream end of shroud 18 are strong and originate in close proximity to inducer blades 16, they impinge directly upon the upstream end of the blades. As a result, the inducer blades of the prior art suffer sever cavitation damage at their upstream end to the extent that pump efficiency is affected and the structural integrity of the blades is often compromised.

The present invention avoids the forementioned problems of the prior art by providing an annular recess 20 in housing 12 which defines an annular space defined by an outer periphery of the shroud and an adjacent surface of the housing. Labyrinth seal means 22 and 24 adjacent the upstream and downstream portions of the shroud respectively serve to minimize recirculation flow. Any recirculation flow seeping past seal means 24 is directed by a diverter 25 into diffuser 26. As depicted, diffuser 26 appears to provide a uniform cross-sectional flow throughout its length. However, it must be appreciated that diffuser 26 extends about the outer circumference of recess 20, thus, fluid passing through it sees a radially increasing cross-sectional flow area. The purpose of diffuser 26 is reduce the velocity of recirculation flow and produce a corresponding decrease in pressure such that the pressure of the fluid at the exit end is substantially less than that at the entrance end, thus insuring that substantially all of the fluid passing seal 24 will flow radially outwardly through diffuser 26. The pressure drop should not be so great, however, that it is less than the inlet pressure adjacent seal 22. Otherwise fluid would tend to leak around seal means 22 and bypass the inducer with a corresponding loss in efficiency.

The recirculating fluid passes through vaneless diffuser 26 and enters chamber 28 which is defined by fluid permeable walls 30. Walls 30 form the essence of the present invention. Specifically, the fluid permeable walls function to remove substantially all tangential velocity components from the fluid passing therethrough. The material from which walls 30 are formed is not particularly critical, provided of course that it is compatible with the fluid to be pumped. Typically, the walls can be formed from powdered metal which has been sintered to form a permeable material. In addition, similar porous ceramic materials also may be utilized. Preferably, the selected material will have a porosity of at least 90%, that is to say it will have a density of less than 10% of that of the base material, the balance being void space. Obviously, of course, there should be no direct flow path through the material. Rather, it should be such that all flow must follow a tortuous flow path with changes in direction to remove any tangential velocity components such that the fluid exiting the porous wall has only a single velocity component.

The pore size is not particularly critical provided of course that it not be so small as to substantially inhibit the flow of fluid therethrough or to readily become plugged with any contaminants which might be anticipated to be in the fluid. The maximum pore size is selected to be less than the boundary layer thickness of the fluid. A preferred pore size can be calculated in accordance with the following equation:

$$\text{Pore size} = 0.924\, D^{3/5} \times \left(\frac{\text{RPM}}{V}\right)^{-1/5}$$

which gives the pore size in inches or alternatively:

$$23470 \times D^{3/5} \times \left(\frac{\text{RPM}}{V}\right)^{-1/5}$$

which will give the pores size in microns.

In the foregoing equations, D=diameter of the inducer shroud in inches. The RPM is the inducer rotating speed in revolutions per minute, and V=the pump fluid kinetic viscosity in feet$^2$/second.

In the embodiment depicted, the mixing chamber in fluid permeable walls 30 is located within a fluid collection zone 32 which is located within housing 12. The fluid passing through walls 30, now free of any tangential velocity components, is collected and reintroduced to the fluid approaching inducer blade 16. Preferably, the fluid is introduced through an angled injection port which provides an axial velocity component corresponding to that of the inlet fluid.

While the invention has been described broadly with respect to recirculating fluids, it will be appreciated by those versed in the art that it is more specifically directed to liquids such as water, liquid metals used for coolant in reactors and propellants utilized for reaction engines. Indeed, a particularly preferred application of the present invention is with a rocket engine which operates at variable thrust levels. The present invention permits the pump to operate over a wider range of rotational speeds and pressure differentials without cavitation than would otherwise be possible.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. In a pump having a shrouded inducer including at least one spiral blade circumferentially surrounded by a shroud, the inducer and blade being rotatably mounted within the housing, said housing having a fluid inlet and a fluid outlet and wherein an annular space defined by an outer periphery of the shroud and an adjacent surface of the housing conveys a recirculation fluid flow over the shroud during operation of the pump, an improvement for alleviating cavitation damage associated with the recirculation flow said improvement comprising:

a first seal means located in said annular space adjacent an upstream end of said shroud;

a second seal means located in said annular space adjacent downstream of said first seal means;

vaneless diffuser means comprising a fluid passageway in said housing having one end opening into said annular space intermediate said first and second seal means;

a mixing chamber in fluid communication with another end of said passageway, said mixing chamber having at least one fluid permeable wall portion forming the only fluid outlet from said chamber; and diverter means located on the outer periphery of said shroud intermediate said first and second seal means for directing recirculation fluid flow into said diffuser means.

2. The pump of claim 1 wherein said first and second seal means comprise labyrinth seals.

3. The pump of claim 2 wherein said fluid permeable wall portion is formed from material having porosity of at least 90%.

4. the pump of claim 3 wherein said fluid permeable wall portion has a median pore size equal to $$0.924\, D^{3/5} \times \left(\frac{\text{RPM}}{V}\right)^{-1/5}$$

where D is the diameter of inducer shroud in inches, RPM is the inducer rotating speed in revolutions/minute and V is the pump fluid kinematic velocity in $ft^2$/second.

5. The pump of claim 4 wherein said fluid permeable wall portion is enclosed in a collecting chamber within said housing and said collecting chamber includes an injector port for reintroducing recirculation flow into said pump.

6. The pump of claim 5 wherein said vaneless diffuser means is angularly disposed for receiving recirculation flow.

7. The pump of claim 6 wherein said diverter means is located adjacent the end of said vaneless diffuser means opening into said annular space intermediate said first and second seal means.

8. The pump of claim 1 wherein said fluid permeable wall portion is formed from material having porosity of at least 90%.

9. The pump of Claim 1 wherein said fluid permeable wall portion has a median pore size equal to $$0.924\, D^{3/5} \times \left(\frac{\text{RPM}}{V}\right)^{-1/5}$$

where D is the diameter of inducer shroud in inches, RPM is the inducer rotating speed in revolutions/minute and V is the pump fluid kinematic velocity in $ft^2$/second.

10. The pump of claim 1 wherein said fluid permeable wall portion is enclosed in a collecting chamber within said housing and said collecting chamber includes an injector port for reintroducing recirculation flow into said pump.

11. The pump of claim 1 wherein said vaneless diffuser means is angularly disposed for receiving recirculation flow.

12. The pump of claim 1 wherein said diverter means is located adjacent the end of said vaneless diffuser means opening into said annular space intermediate said first and second seal means.

* * * * *